US009599349B2

(12) United States Patent
Gluf

(10) Patent No.: US 9,599,349 B2
(45) Date of Patent: Mar. 21, 2017

(54) UTILITY OVEN DOOR ROLLER GLIDE SYSTEM

(71) Applicant: Electrolux Home Products, Inc., Charlotte, NC (US)

(72) Inventor: Carl Gluf, Hendersonville, TN (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 0 days.

(21) Appl. No.: 14/831,273

(22) Filed: Aug. 20, 2015

(65) Prior Publication Data

US 2016/0242544 A1 Aug. 25, 2016

Related U.S. Application Data

(60) Provisional application No. 62/118,829, filed on Feb. 20, 2015.

(51) Int. Cl.
*F24C 15/00* (2006.01)
*F24C 15/16* (2006.01)

(52) U.S. Cl.
CPC ..... *F24C 15/16* (2013.01); *A47B 2210/17* (2013.01)

(58) Field of Classification Search
CPC . A47B 88/04; A47B 88/0466; A47B 88/0418; A47B 88/0422; F24C 15/16; F24C 15/168
USPC ..... 312/410
See application file for complete search history.

(56) References Cited

U.S. PATENT DOCUMENTS

| | | | | |
|---|---|---|---|---|
| 2,378,419 | A | 6/1945 | Loeb et al. | |
| 2,418,244 | A * | 4/1947 | Baird | A47B 88/10 312/334.19 |
| 2,898,159 | A * | 8/1959 | Arnit | A47B 88/10 312/334.19 |
| RE26,666 | E | 9/1969 | Marateck et al. | |
| 4,595,247 | A * | 6/1986 | Zank | A47B 88/14 312/334.19 |
| 4,874,209 | A * | 10/1989 | Spitzer | A47B 88/02 16/29 |
| 2013/0313954 | A1* | 11/2013 | Koelling | A47B 88/0466 312/319.1 |
| 2014/0239793 | A1* | 8/2014 | Armstrong | A47B 88/0451 312/410 |

* cited by examiner

*Primary Examiner* — Daniel Rohrhoff
(74) *Attorney, Agent, or Firm* — Pearne & Gordon LLP

(57) ABSTRACT

A drawer assembly includes a roller glide system configured to facilitate sliding movement between an extended and a retracted position of a drawer. The roller glide system includes, at each lateral side of the drawer, a first and a second roller glides, each disposed between the drawer and a supporting frame for the drawer. The first and the second roller glides each include a wheel, a glide frame, a bearing shaft mount for coupling the wheel, and a wheel side load bearing formed as an arcuate protrusion from each bearing shaft mount and configured to support the exterior lateral periphery of the wheel when coupled to each glide frame. The second roller glide also includes a base rail bearing for guiding the second roller glide along a rail of the supporting frame.

23 Claims, 8 Drawing Sheets

UTILITY OVEN DOOR ROLLER GLIDE SYSTEM

CROSS-REFERENCE TO RELATED APPLICATIONS

This application claims the benefit of U.S. Provisional Patent Application Ser. No. 62/118,829 entitled "UTILITY OVEN DOOR ROLLER GLIDE SYSTEM" which was filed Feb. 20, 2015. The entirety of the aforementioned application is herein incorporated by reference.

BACKGROUND

Field of the Invention

The following description relates generally to a cooking appliance and, more specifically, to a roller glide assembly for supporting a utility drawer or other extractable element within an oven range.

SUMMARY

The following presents a simplified summary of the invention in order to provide a basic understanding of some example aspects of the invention. This summary is not an extensive overview of the invention. Moreover, this summary is not intended to identify critical elements of the invention or to delineate the scope of the invention. The sole purpose of the summary is to present some concepts in a simplified form as a prelude to the more detailed description that is presented later.

According to one general aspect, a drawer assembly may be provided. The drawer assembly may include a roller glide system configured to facilitate sliding movement between an extended and a retracted position of a drawer. The roller glide system may include, at a first lateral side of the drawer, a first roller glide and a second roller glide. The first roller glide and the second roller glide may be disposed between the drawer and a supporting frame for the drawer. The first roller glide may be fixed to the drawer for sliding engagement of a first element fixed to and extending longitudinally of the supporting frame. The second roller glide may be fixed to the supporting frame for sliding engagement of a second element fixed to and extending longitudinally of the drawer. The second roller glide includes at least one base rail bearing for guiding the second roller glide along the second element.

In another general aspect, the first roller glide may comprise a first wheel that rotates against the first element to facilitate sliding engagement therebetween.

In another general aspect, the first element may comprise a first rail depending from the drawer and having a flat surface over which the first wheel rotates, and which is supported against the first wheel.

In another general aspect, the second roller glide may comprise a second wheel that rotates against the second element to facilitate sliding engagement therebetween.

In another general aspect, the second element may comprise a second rail having a flat surface over which the second wheel rotates, and which is supported against the second wheel.

In another general aspect, the roller glide system comprises, at a second lateral side of the drawer opposite the first lateral side of the drawer, third and fourth roller glides disposed between the drawer and the supporting frame. The third roller glide is a mirror image of the first roller glide and the fourth roller glide is a mirror image of the second roller glide.

In another general aspect, the first roller glide comprises a first glide frame, a first bearing shaft mount as part of the first glide frame, with the first wheel coupled to a first wheel shaft configured to be seated in the first bearing shaft mount. The first roller glide also comprises a drawer box guide, a drawer stop on each longitudinal side of the first glide frame, and a first wheel side load bearing formed as a protrusion from the first shaft mount and extending along an arc. The first wheel side load bearing is configured to support the exterior lateral periphery of the first wheel when coupled to the first glide frame.

In another general aspect, bending of the first wheel shaft is limited based on the engagement of the first wheel against the first wheel side load bearing.

In another general aspect, the first glide frame is formed symmetrical relative to its vertical axis.

In another general aspect, the second roller glide comprises a second glide frame. The at least one base rail bearing extends from the base of the second glide frame generally toward and cooperating with the circumferential surface of the second wheel to define a pathway therebetween through which the second element translates relative to the second roller glide when the drawer slidably moves relative to the supporting frame.

In another general aspect, the second glide frame comprises a second bearing shaft mount as part of the second glide frame. The second wheel is coupled to a second wheel shaft seated in the second bearing shaft mount. The second glide frame also comprises a base rail side load bearing and a second wheel side load bearing formed as a protrusion from the second shaft mount and extending along an arc. The second wheel side load bearing is configured to support an exterior lateral periphery of the second wheel when coupled to the second glide frame.

In another general aspect, bending of the second wheel shaft is limited based on the engagement of the second wheel against the second wheel side load bearing.

In another general aspect, at least one of the first and second roller glides comprises a snap fit protrusion extending therefrom and configured to be inserted into a compatibly-shaped slot formed on the drawer or the supporting frame, respectively.

In another general aspect, the slot comprising a keyhole shape has a first portion dimensioned to allow ready insertion of the protrusion and a smaller second portion into which the protrusion can be subsequently positioned and which provides a frictional interference fit therewith.

In another general aspect, the first roller glide comprises protruding portions formed symmetrically on both sides of the first glide frame facing the supporting frame. The protruding portions are configured to deform when the first roller glide is secured to the supporting frame.

In another general aspect, the protruding portions may be formed of a resilient plastic material configured to deform against the supporting frame to provide a tight fit between the first roller glide and the supporting frame.

In another general aspect, the second roller glide comprises protruding portions formed symmetrically on both sides of the second glide frame facing the first lateral side wall of the drawer. The protruding portions may be configured to deform when the second roller glide is secured to the first lateral side wall of the drawer.

In another general aspect, the protruding portions are formed of a resilient plastic material configured to deform against the first lateral side wall of the drawer to provide a tight fit between the second roller glide and the first lateral side wall of the drawer.

In another general aspect, a cooking appliance may be provided. The cooking appliance may include a drawer assembly comprising a roller glide system configured to facilitate sliding movement between an extended and a retracted position of a drawer. The roller glide system may include, at a first lateral side of the drawer, a first roller glide and a second roller glide. The first roller glide and the second roller glide may be disposed between the drawer and a supporting frame for the drawer. The first roller glide may be fixed to the drawer for sliding engagement of a first element fixed to and extending longitudinally of the supporting frame. The second roller glide may be fixed to the supporting frame for sliding engagement of a second element fixed to and extending longitudinally of the drawer. The second roller glide comprises at least one base rail bearing for guiding the second roller glide along the second element.

In another general aspect, a method of assembling a drawer assembly may be provided. The method may include the step of arranging a first roller glide and a second roller glide between a drawer and a supporting frame for the drawer to facilitate sliding movement between an extended and a retracted position of the drawer. The method may further include the step of attaching the first roller glide to the drawer for sliding engagement of a first element fixed to and extending longitudinally of the supporting frame. The method may also include the step of attaching the second roller glide to the supporting frame for sliding engagement of a second element fixed to and extending longitudinally of the drawer. The second roller glide comprises at least one base rail bearing for guiding the second roller glide along the second element.

In another general aspect, the method of assembling a drawer assembly may further include the step of providing at least one of the first and second roller glides with a snap fit protrusion extending therefrom and configured to be inserted into a compatibly-shaped slot formed on the drawer or on the supporting frame, respectively. The method may further include the step of securing at least one of the first and second roller glides on the supporting frame or on the lateral side wall of the drawer body using a frictional interference fit between the snap fit protrusion and a keyhole shape having a first portion dimensioned to allow ready insertion of the protrusion and a smaller second portion into which the protrusion can be subsequently positioned and which provides a frictional interference fit therewith.

In another general aspect, the method of assembling a drawer assembly may further include the step of providing at least one of the first and second roller glides with protruding portions formed symmetrically on both sides of at least one of the first and second roller glides. The method may further include the step of configuring the protruding portions to deform when at least one of the first and second roller glides is secured to the supporting frame or to the first lateral side wall of the drawer. The method may also include the step of securing the at least one of the first and second roller glides to the supporting frame or on the first lateral side wall of the drawer.

Other features and aspects may be apparent from the following detailed description, the drawings, and the claims.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION

Figure 1:
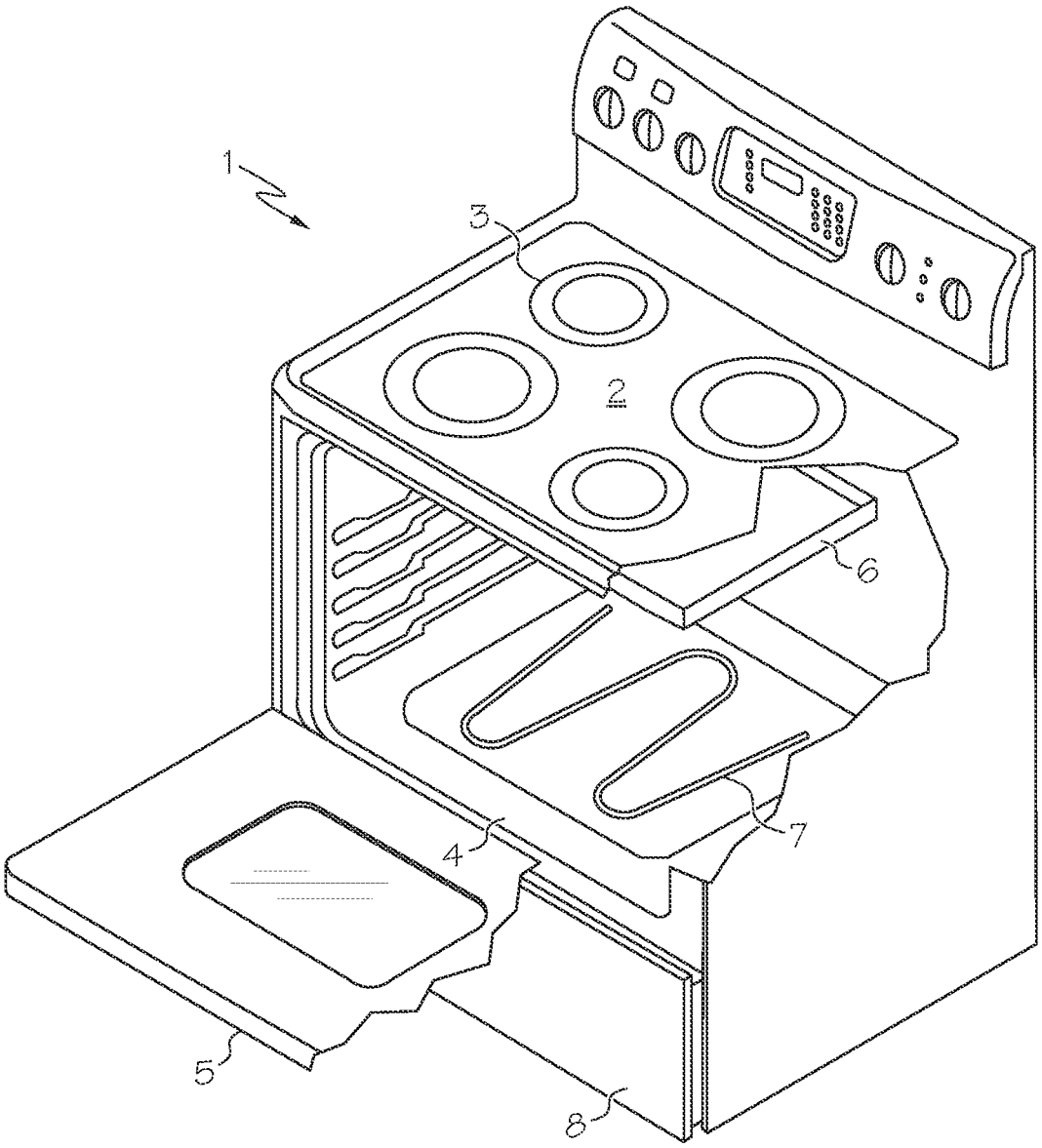
FIG. 1 is a front perspective view of a cooking appliance having a drawer arranged beneath an oven cavity.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

An illustrative embodiment of a cooking appliance in the form of an oven range 1 is shown in FIG. 1. As shown, the oven range 1 includes a cooktop surface 2 including a plurality of burners 3 on which pans or other cooking vessels containing food items can be placed to be heated. An oven cavity 4, to which access is opened or closed by an oven door 5, is arranged beneath the cooktop surface 2 and defines a space in which a broil element 6 and/or bake element 7, for example, emit(s) heat to cook food. The oven range 1 also includes a drawer 8 that slides outwardly to be extracted from a position underneath the oven cavity 4 to a position where the contents of the drawer 8 are accessible by a user from outside the oven range 1. The drawer 8 can be, for example, a warming drawer, a storage drawer or a drawer having another purpose or function. Although the drawer 8 is described below as an example of an extractable element that travels along roller glides as hereafter described, it is to be understood that roller glides described herein can be utilized to slidably support extractable elements having configurations other than that of a drawer, so that such element(s) can be pulled to withdraw it/them from the oven range 1 and subsequently returned.

A roller glide system includes one or a plurality of roller glides installed between the frame or another stationary member of the oven range 1 and the drawer 8 to facilitate smooth, sliding engagement between them to enable opening and closing of the drawer 8 via withdrawal and insertion, respectively, of that drawer 8 in the range 1.

In the embodiments described here, a roller glide system includes two roller glides disposed between a drawer or other extractable element and a frame or other stationary element of an oven range, one roller glide being mounted to each of the drawer/extractable element and the frame/stationary element and configured to receive and accommodate a flange or other surface formed or affixed to the opposing element (i.e. drawer or frame) as the drawer slides. In preferred embodiments each roller glide has a wheel comprised of one or a plurality of rollers that ride against the accommodated flange or other surface affixed to the opposite element (drawer or frame). Such a configuration results in a low-cost solution for providing the superior feel of smooth-operating drawers typically offered by higher-cost linear bearing systems. However, embodiments are not limited thereto and other configurations may be utilized, for example roller glides having fixed bearing surfaces that slide (without rotation) against the aforementioned flange or other surface of the opposing element. Still, other embodiments may include, for example, a post and bushing acting as a wheel, a steel axle attached to a wheel, or a ball-bearing type wheel as is described in detail below.

Figure 2:
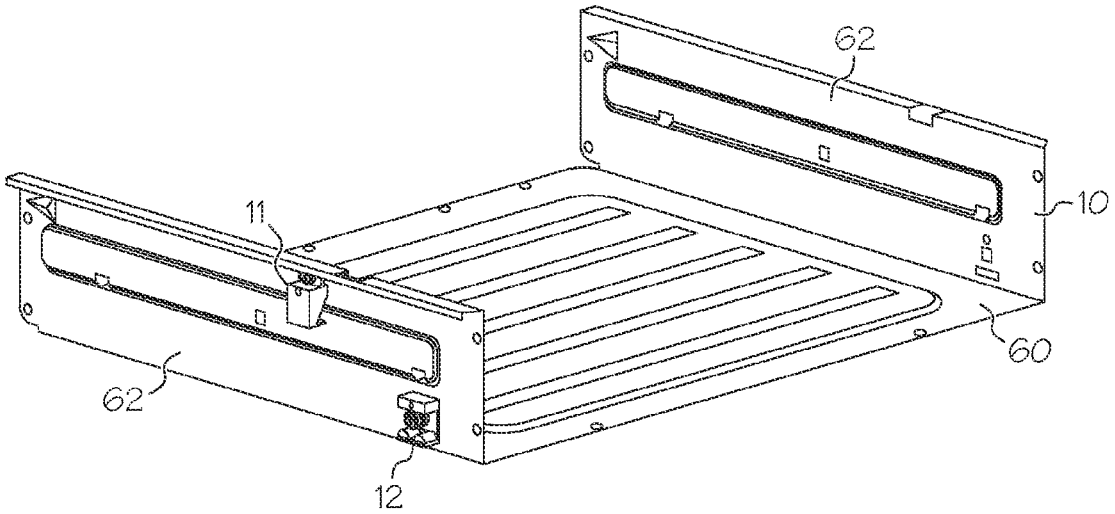
FIG. 2 is a rear perspective view of a drawer body with two roller glides positioned along one side of the body according to an embodiment, wherein one roller glide would be coupled to a frame or other stationary member of the oven range in use to support and guide the drawer body (e.g. a flange or overhang thereof) as the door is inserted and withdrawn, and the other roller glide is coupled to the drawer body.

FIG. 2 illustrates a drawer body 10 of the drawer 8. The drawer body 10 includes a platform 60 on which objects stored in the drawer 8 rest, and two vertical side walls 62 that extend upward from the platform 60 at opposite lateral sides of the drawer 8. The drawer 8 also can include front and rear walls, not shown in the figure. Two roller glides 11, 12 are arranged between a side wall 62 of the drawer body 10 and the oven frame, or other stationary member of the oven range 1, to slidably couple the drawer body 10 to the oven range 1. In preferred embodiments respective sets or pairs of first and second roller glides 11, 12 as hereafter described can be positioned adjacent each of the opposite side walls 62 of the drawer 8 and an associated portion of the frame. In such instances the respective pairs of roller glides 11, 12 at opposite sides of the drawer 8 preferably will be mirror images of one another. However, for brevity and simplicity the remaining description is given for a single pair of roller glides adjacent one of the side walls 62 and an associated portion of the range frame. Referring still to FIG. 2, in the illustrated embodiment the first roller glide 11 is configured to be coupled at a fixed location to the oven frame 17 (not shown in FIG. 2 for clarity but seen in FIG. 12) or other stationary member of the oven range 1 so that the first roller glide 11 is stationary relative to the oven range 1. The first roller glide 11 remains fixed as the drawer 8 is pulled from and returned to its receiving cavity in the oven range 1. A second roller glide 12 can be fixed to the side wall 62 of the drawer body 10 so that the second roller glide 12 is stationary relative to the drawer body 10, and travels along with the drawer 8 as it is slidably withdrawn from and returned to its receiving cavity.

In one embodiment, the first roller glide 11 and the second roller glide 12 can be made of a moldable synthetic or semi-synthetic plastic material. However, embodiments are not limited thereto and other materials, including but not limited to metal or combinations of metal and plastic, may be utilized.

Figure 3:
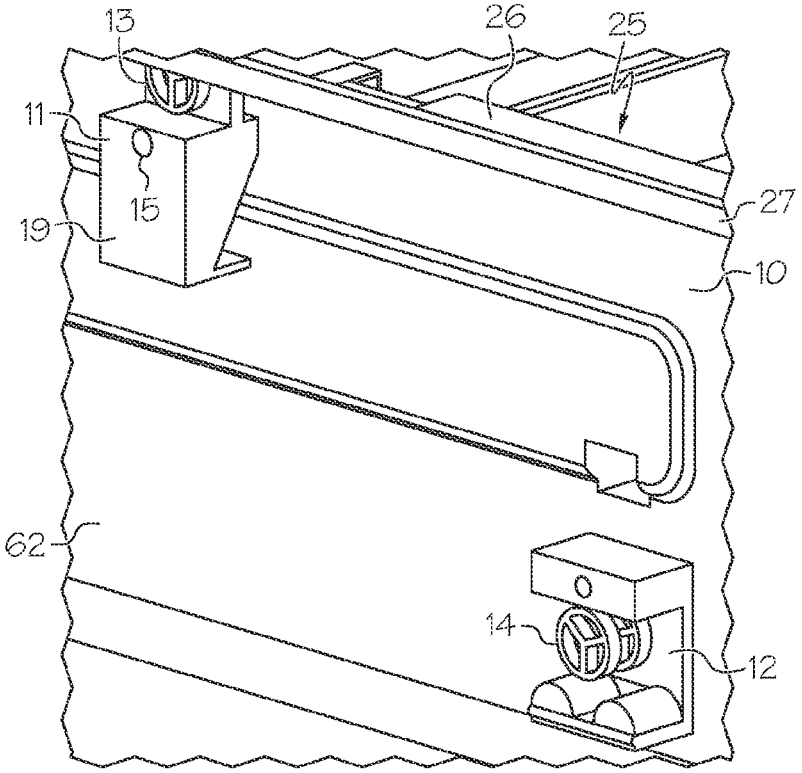
FIG. 3 is an enlarged rear perspective view showing the roller glides in FIG. 2 in more detail.
Figure 12:
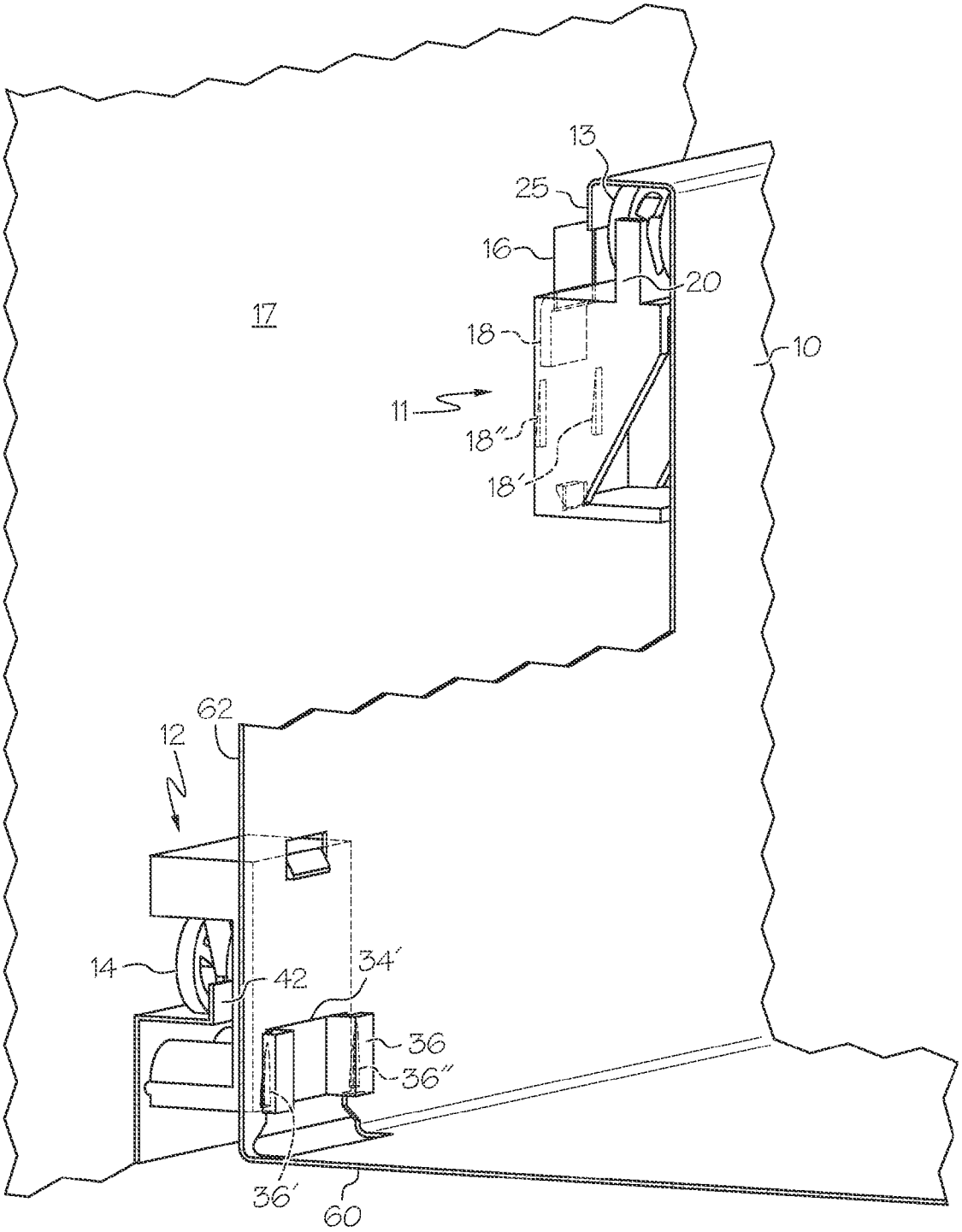
FIG. 12 is a rear perspective view looking from inside the drawer cavity and showing the first roller glide and the second roller glide in a position wherein the drawer has been withdrawn to a maximum or near-maximum extent from the cooking appliance.

As shown in the enlarged view of FIG. 3, the first roller glide 11 and the second roller glide 12 each have a wheel 13 and 14, respectively. The wheels 13 and 14 will be described in more detail with reference to FIG. 6 and FIG. 7 below. In operation to slidably guide the movement of the drawer 8 relative to the oven range 1, the wheel 14 of the second roller glide 12 contacts and rolls against a flange or other rail extending from or fixed to the frame or other stationary member of the oven range 1. The flat rail and the frame of the oven range are not shown in FIG. 3, but are illustrated in FIG. 12 discussed in detail below. At the same time, the wheel 13 of the first roller glide 11 contacts and rolls against a rail, such as flange 25, fixed or formed to the drawer 8 and extending from the side wall 62. As will be appreciated and explained in more detail below, the wheels 13 and 14 slidably support and guide the side wall 62 of the drawer 8, and thereby the drawer 8 itself, as it is withdrawn from and returned to the associated receiving cavity within the oven range 1 consistent with how drawers are normally operated.

Figure 4:
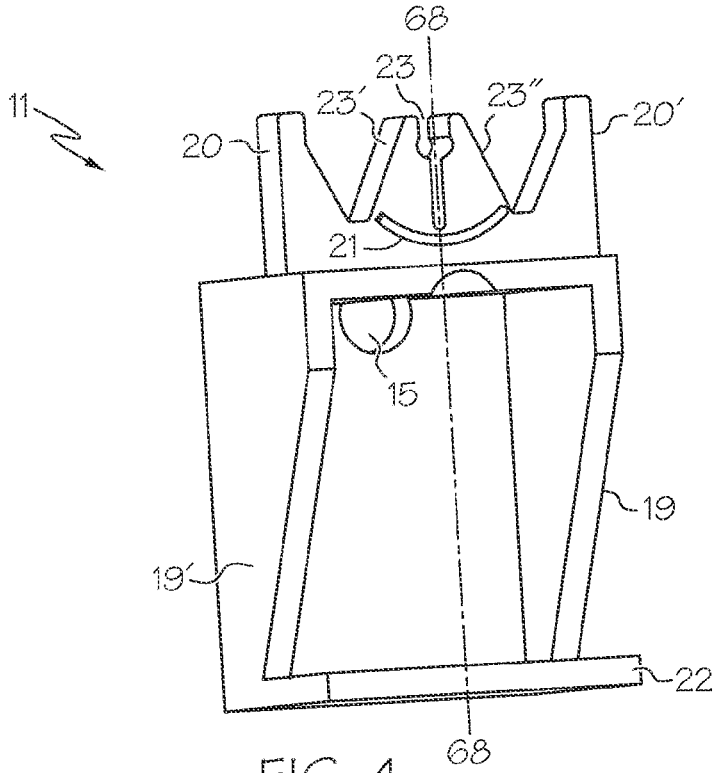
FIG. 4 is a perspective view of a glide frame of a first roller glide that is to be coupled to a frame or another stationary member of the cooking appliance according to an embodiment.

FIG. 4 illustrates a perspective view of an embodiment of the glide frame 19 of the first roller glide 11 without the wheel 13 installed, as viewed from the side that faces the drawer body 10 in operation. The glide frame 19 of the first roller glide 11 includes optional drawer stops 20 and 20' on either side of the glide frame 19, spaced longitudinally from one another relative to the direction of slidable travel of the drawer 8 in use. The drawer stops 20, 20' can be protrusions integrally molded as part of a monolithic structure to extend upwardly from the glide frame 19. In the illustrated embodiment the glide frame 19 also has a wheel side-load bearing 21, a drawer box guide 22, and a bearing shaft mount 23. FIG. 4 also shows a mounting opening 15 for mounting of the first roller glide 11, as discussed below.

The wheel side load bearing 21 shown in FIG. 4 is preferably formed as a protrusion from the shaft mount 23 that extends along a circular arc, and having an outward-facing, optionally planar surface located within close proximity to the exterior lateral periphery of the wheel 13 when the wheel 13 is coupled to the glide frame 19. The wheel side load bearing 21 provides lateral support to the wheel 13 as it rotates along the drawer flange 25 when the drawer 8 travels in or out from the appliance. Optionally, in embodiments where respective wheels 13 are disposed on a common shaft received in the shaft mount 23 on opposite sides thereof, the opposite sides can each have respective ones of the aforementioned wheel side load bearings 21. When the wheel 13 is coupled to the shaft mount 23, each wheel 13 rests against the respective wheel side load bearings 21. As a result, bending of the wheel shaft caused from torsional loads would be limited based on the engagement of the wheel against the respective wheel side load bearing 21. The wheel side load bearing(s) 21 thus reduce bending forces acting on the wheel shaft, and transferred to the bearing shaft mount 23, thus minimizing wear on the shaft and on the associated shaft mount 23 from torsional loads.

The drawer box guide 22 can include a flange formed with the glide frame 19, e.g. integrally formed as a monolithic unit with the remainder of the glide frame 19. The drawer box guide 22 can include a contact surface that is to abut against a side wall 62 of the drawer body 10 while the drawer body 10 is sliding. This provides additional lateral support to the oven drawer 8 from the glide frame 19 affixed to the frame, and where respective first roller glides 11 are arranged adjacent each of the opposite side walls 62 of the drawer body 10, between the glide frames 19 of the opposing first roller glides 11. This can help center the drawer 8 and to maintain it on-track as it slides.

Figure 5:
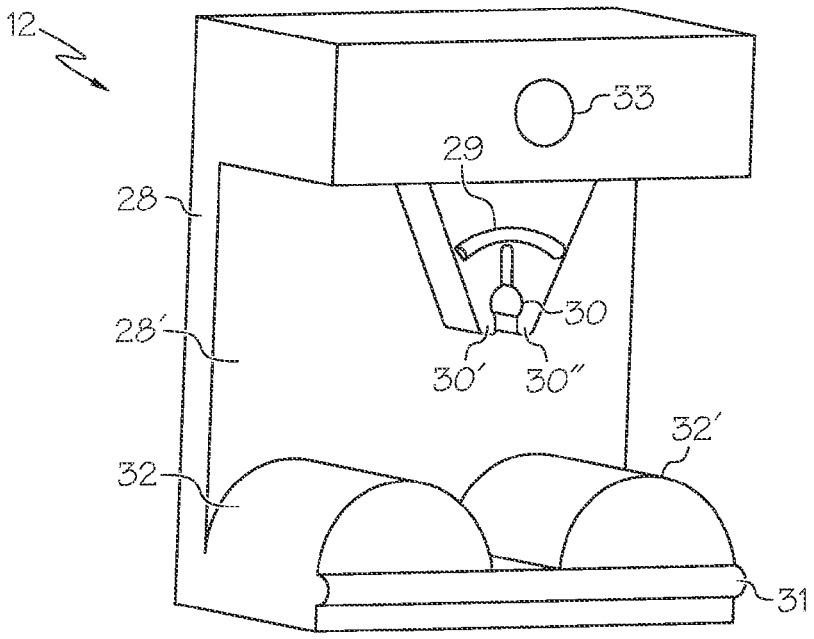
FIG. 5 is a perspective view of a glide frame of a second roller glide that is to be coupled to the utility drawer or other extractable element of the cooking appliance according to an embodiment.

FIG. 5 illustrates a perspective view of an embodiment of the glide frame 28 of the second roller glide 12 without the wheel 14 installed, as viewed from the side that faces away from the drawer (toward the frame) in operation. As shown in FIG. 5 and similarly as the first roller glide 11 discussed above, the glide frame 28 of the second roller glide 12 includes a wheel side load bearing 29 protruding at the bearing shaft mount 30 to support and act against lateral loads from the wheel 14 in operation. In embodiments where two wheels 14 are mounted on a common shaft and disposed on either side of the shaft mount 30 in the roller glide 12, similar side load bearings 29 may protrude from either side of the mount 30 to act against lateral loads from each of the respective wheels 14. The glide frame 28 in the illustrated embodiment also includes a base rail side load bearing 31, and base rail bearings 32 and 32'.

The wheel side load bearing(s) 29 preferably is/are formed as a protrusion from the shaft mount 30. In the illustrated embodiment a side load bearing 29 extends along a circular arc, and has an outward-facing, optionally planar surface that provides lateral support to each wheel 14 as it rotates against a flange or rail integrally formed with, or fixed to, the frame or other stationary member of the range; e.g. a flat base rail 42 as seen in FIG. 12 described below. Thus, bending forces acting on the wheel shaft, and transferred to the shaft mount 30 of the second roller glide 12, can be similarly reduced, and the associated wear reduced, as discussed above.

The base rail side load bearing 31 can include a longitudinally-extending protrusion, optionally having or defining a planar surface facing outward from the second roller glide 12 for engaging a surface of the oven frame in sliding operation of the drawer 8 to which the glide 12 is fixed. The bearing 31 can be formed of the same material as that forming the remainder of the glide frame 28, and can optionally be integrally formed, as a monolithic unit with the remainder of the glide frame 28.

The base rail bearings 32 and 32' can be formed as raised, arcuate surfaces extending upward from a base of the glide frame 28, generally toward the bearing shaft mount 30. The rail bearings 32 and 32' are configured and dimensioned such that in operation they cooperate with the circumferential surface(s) of the wheel(s) 14 journaled on a bearing shaft that is received within the shaft mount 30 to define a pathway or receiving channel for a flange or rail 42 (shown in FIG. 12) extending from the frame or other stationary member of the oven range 1, and against which the roller(s) 14 roll, while the drawer body 10 slidably moves relative to the oven range 1. Normally the roller(s) 14 will rest on an upper surface of the rail 42, thus supporting at least a portion of the weight of drawer 8. However, in operation as the drawer is advanced and withdrawn along its track (i.e. along the drawer flange 25 and rail 42), some upward force may be exerted by a user in pulling or pushing, which would tend to lift the drawer, and thereby the second roller glide 12, off of the rail 42. When that occurs, the rail bearings 32 and 32' act against such upward force and retain the rail 42 seated properly within the path defined within the roller glide 12.

Figure 6:
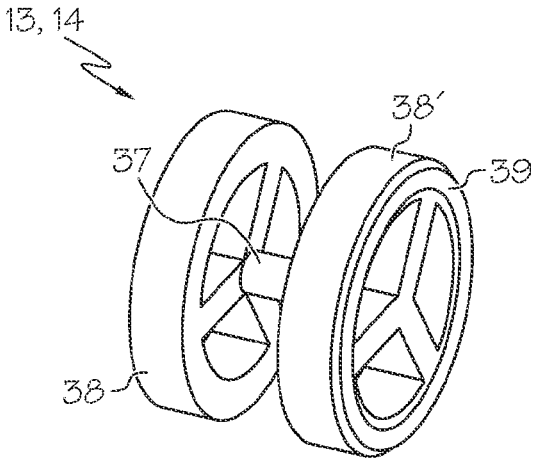
FIG. 6 is a perspective view of a wheel design for a roller glide according to an embodiment.

The first roller glide 11, the second roller glide 12, or both roller glides 11, 12, can be symmetric about a respective vertical axis between longitudinally-spaced (i.e. relative to the drawer direction of travel) sides of the respective roller glide 11, 12. For example, as shown in FIG. 4, the glide frame 19 of the first roller glide 11 is symmetrical about the vertical axis 68-68. Thus, the drawer stops 20, 20' are similarly arranged as mirror images about the vertical axis 68-68, as are the other structural features of the glide frame 19. Such a symmetric arrangement allows the first roller glide 11 to function and perform equivalently on either side of the oven drawer 8, adjacent either of the opposing lateral side walls 62 thereof. This enables installation of the identical first roller glides 11 on either side of the oven drawer 8. Similar considerations apply to making the second roller glide 12 symmetric between longitudinal-spaced sides thereof, as seen in FIG. 6 (wherein wheel 14 is not installed). In other words, the symmetrical embodiments of the first roller glide 11 and/or the second roller glide 12 can be installed at both the left and the right sides of the drawer body 10 to slidably support the drawer body 10 on the oven range, thereby eliminating the need to inventory and install separate left- and right-handed roller glides 11, 12.

FIG. 6 illustrates the wheels 13 (or 14) of a first roller glide 11 (or a second roller glide 12) according to an embodiment. The same design of the wheels 13 (or 14) can optionally be used for the first roller glide 11 and the second roller glide 12, as well as for such glides whether installed at the left or right side of the drawer body 10. In the embodiment illustrated in FIG. 6, two tandem wheels 38 and 38' are mounted at either end of a common shaft 37, forming a "split-wheel" configuration. Each of the two wheels 38 and 38' has a side load bearing 39 on the external side facing away from the shaft (only one side bearing 39 is shown in FIG. 6).

The side load bearings 39 include a bearing surface that protrudes laterally outward, away from the external side surface of each wheel 38, 38', and can make contact with an opposing surface to prevent the wheels 38, 38' from bending beyond a tolerable limit. The load bearings 39 can be formed with a circular shape, such as a ring centered at the shaft 37.

Any suitable configuration may be utilized for mounting a wheel 13 (or 14) into the bearing shaft mount 23 (or 30) of the first (or second) roller glide described above. For example, a "split-wheel" configuration comprising two wheels 38 and 38' and a supporting wheel shaft 37 may be installed into the bearing shaft mount 23 of the glide frame 19 of the first roller glide 11 between two mounting tabs 23' and 23" that together define the shaft mount 23 as illustrated in FIG. 4. The mounting tabs 23', 23" can be protrusions integrally molded as part of a monolithic structure between the two drawer stops 20 and 20', although any other structure that can support mounting of a "split-wheel" configuration may be used. In this embodiment, the supporting wheel shaft 37, may be installed by pressing the supporting wheel shaft 37 into the bearing shaft mount 23, briefly separating the two tabs 23' and 23" (or 30' and 30") at a narrow mouth between them, which snap back to their resting configuration once the shaft 37 passes the mouth and is received in the shaft seat whose dimensions substantially correspond to a cross-section of the shaft. When a wheel 13 (or 14) having a split-wheel configuration as shown in FIG. 6 is installed, the wheels are journaled for rotation centered on the shaft 37 and are disposed respectively on opposite sides of the wheel mount 23 (or 30).

Grease or lubricant may be used to help reduce the friction between the bearing shaft mount 23 (or 30) and the wheels shaft 37, thus enabling freer and smoother rotation of the wheels 38, 38'.

The two wheels 38 and 38' and the shaft 37 in the split-wheel configuration may be made from a different type of plastic with different hardness compared to the plastic material used for the glide frames 19 and 28 to reduce friction and to prevent galling, i.e., the wear caused by the combination of friction and adhesion between the sliding surfaces of the shaft 37 and the two wheels 38 and 38', or between the shaft 37 and the shaft mount 23 (or 30). However, embodiments are not limited thereto and other materials, including but not limited to metal or combinations of metal and plastic, are possible.

Any of several different mounting configurations may be utilized for assembling the shaft 37 and the two wheels 38 and 38'. In particular embodiment, when the shaft 37 and the two wheels 38 and 38' are formed of metal instead of plastic, the shaft 37 may be assembled to the two wheels 38 and 38' by using metal-assembled friction which relies on the tensile and compressive strengths of the materials the shaft 37 and the two wheels 38 and 38' are made from. In this embodiment, the friction between the shaft 37 and the two wheels 38 and 38' can be increased by compression of the shaft 37 and each of the two wheels 38 and 38' against each other, rather than by any other means of fastening.

In another embodiment, the shaft 37 may be coupled to the two wheels 38 and 38' by using metal ultrasonic welding. According to yet another embodiment, the shaft 37 may be coupled to the two wheels 38 and 38' by using metal rivets or similar permanent mechanical fasteners. However, embodiments are not limited thereto and other configurations are possible.

Figure 7:
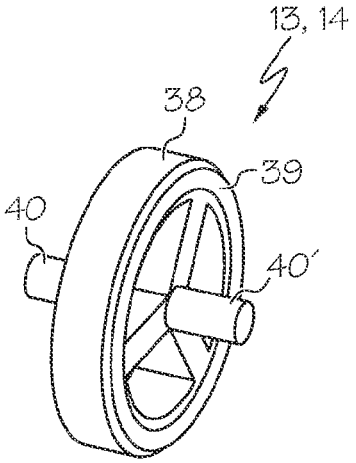
FIG. 7 is a perspective view of a wheel design for a roller glide according to another embodiment.

FIG. 7 illustrates an alternative wheel design which may be utilized for alternative embodiments of one or both the first roller glide 11 and the second roller glide 12, for example the alternative embodiment of the second roller glide 12 illustrated in FIG. 8 and described below. The alternative wheel 13 or 14 shown in FIG. 7 has a single wheel 38 and two outward axle protrusions 40 and 40' formed on the two sides of the wheel 13 or 14. This alternative wheel design may be utilized when assembling the wheel 13 or 14 of the first roller glide 11 and the second roller glide 12, respectively, by inserting the outward axle protrusions 40 and 40' formed on the two sides of the wheel 13 or 14 into respective, axially-aligned openings formed in the glide frame 19 of the first or second roller glide 11 or 12. Similarly to the wheels 13 and 14 described above with respect to FIG. 6, the alternative wheel 13 or 14 illustrated in FIG. 7 may include a side load bearing 39 on the external side of the wheel 38 facing the drawer rail 26. Such side load bearings 39 can be formed as a circular, ring-shaped surface with a center concentric with the wheel 13 or 14.

Figure 8:
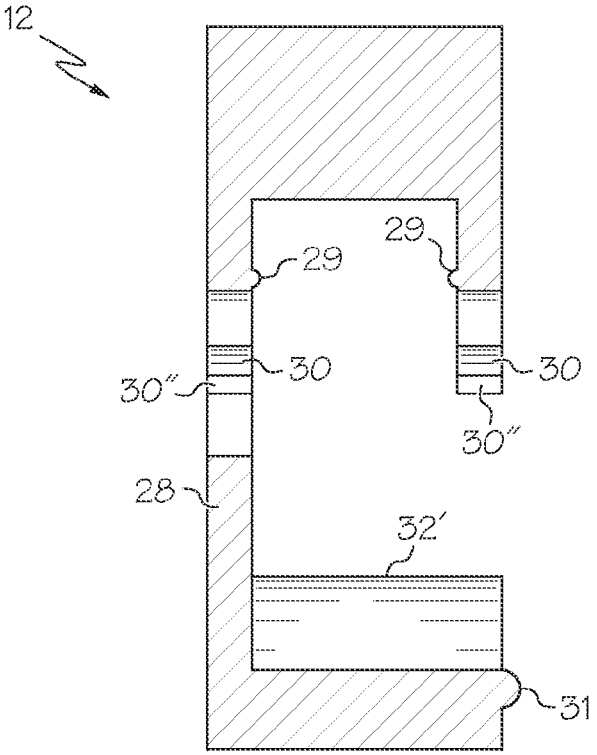
FIG. 8 is a cross-sectional view of a glide frame of a second roller glide that is to be coupled to the utility drawer or other extractable element of the cooking appliance and that is configured for the wheel design shown in FIG. 7 according to an embodiment.

FIG. 8 is a cross-sectional view of an embodiment of the second roller glide 12 that may be utilized for the alternative single-wheel design shown in FIG. 7. As shown in FIG. 8, the second roller glide 12 has two bearing shaft mounts 30 formed symmetrically on opposite sides of the second roller glide 12. In this embodiment, the bearing shaft mounts 30 may be formed with respective axially-aligned openings in which the wheel shaft 37 of the wheel 14 may be assembled by inserting the outward protrusions 40 and 40' (shown in FIG. 7) formed on the sides of the wheel shaft 37 therein. Similarly to the embodiment of the second roller glide 12 illustrated in FIG. 5 and described above, the glide frame 28 of the second roller glide 12 shown in FIG. 8 includes two wheel side load bearings 29 protruding at each of the bearing shaft mounts 30 to support the wheel 14 and to act against lateral loads from the wheel 14 in operation. The side load bearings 29 may protrude from each internal side of the bearing shaft mounts 30 (i.e., from the portions of the bearing shaft mounts 30 that face each other) to act against lateral loads from the wheel 14. The glide frame 28 in the illustrated embodiment also may include a base rail side load bearing 31, and base rail bearings 32 and 32' (only base rail bearing 32' is shown in FIG. 8).

Although FIG. 8 illustrates an alternative embodiment of the second roller glide 12 for the single-wheel design shown in FIG. 7, the same mounting configuration to accommodate the single-wheel design shown in FIG. 7 may also be used for the first roller glide 11.

Turning back to FIG. 2 and FIG. 3, in one embodiment, the first roller glide 11 may be mounted to the oven range frame with a fastener, such as a screw, bolt, or the like, extending through the glide frame 19 of the first roller glide 11. The fastener may be inserted through a mounting opening 15 (shown in FIG. 2 and FIG. 3) formed in the upper portion of the glide frame 19 and an aligned opening formed in the frame of the oven range to fix the first roller glide 11 in place. The glide frame 19 supports the wheel 13 of the first roller glide 11 at a location where the drawer flange 25 or other rail structure fixed to the drawer 8 extends laterally from the side wall 62, and runs longitudinally (i.e. parallel to the direction of movement of the drawer) along that wall. In the illustrated embodiment the flange 25 (as shown in FIG. 3) rides on top of the wheel 13 as the oven drawer 8 is withdrawn from and inserted into the oven range 1. The drawer flange 25 can be formed by bending a portion of metal, molding a non-metallic material, or otherwise integrally forming the drawer flange 25 along with its respective side wall 62 as part of a monolithic structure. The drawer flange 25 can include a flat rail portion 26 along which the wheel 13 travels, and optionally a downward-extending portion 27 that acts as a guide to interfere with lateral displacement of the drawer flange 25 off of the wheel 13 during adjustment of the drawer 8; i.e., to prevent separation of the flange 25 from the wheel 13, which would cause the drawer to move off-track. In other words, the downward-extending portion 27 protrudes downwardly from the substantially-horizontal drawer rail 26 to define a channel with a cross section resembling a "n" shape, in which the wheel 13 is received as shown in FIG. 2. The flat rail portion 26 can be formed of the same material as that forming the drawer body 10 and can optionally be integrally molded or formed as part of the monolithic structure of the drawer body 10 along the top of each respective side wall 62 of the drawer body 10.

Figure 9A:
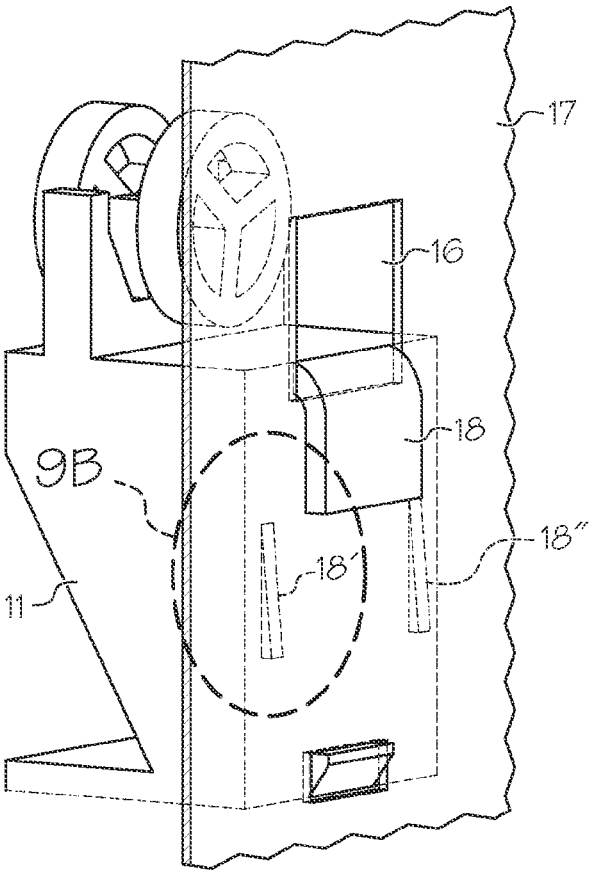
FIG. 9A is a rear perspective view of a no-fastener design of a first roller glide coupled to a frame or other stationary member of the cooking appliance according to an embodiment, viewed from a position generally behind where the glide is coupled to the frame or other member.
Figure 9B:
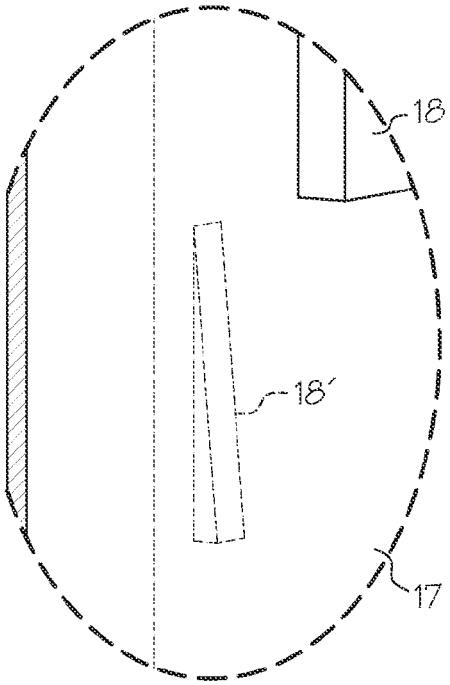
FIG. 9B is an enlarged rear perspective view of a portion of the no-fastener design of a first roller glide shown in FIG. 9A.

In another embodiment, the first roller glide 11 may be mounted to the oven range frame without a separate fastener via a snap fit between the first roller glide 11 and the frame or other stationary member to maintain its position on the oven range 1. FIG. 9A and FIG. 9B illustrate an embodiment of such a "no fastener" snap fit configuration of the first roller glide 11. As shown in FIG. 9A, a slot 16 or other suitable aperture for receiving a tab 18 of the first roller glide 11 can be formed in the oven range frame 17. The tab 18 or other protrusion may be formed to extend from the rear side of the first roller glide 11. The tab 18 is configured to be inserted into the compatibly-shaped slot 16, which can optionally have a "keyhole" shape, with a relatively-large upper portion allowing for ready insertion of the tab 18 and a relatively-small or narrower lower portion into which the tab 18 is subsequently positioned. Once positioned in the relatively-small lower portion, a friction fit between the tab 18 and the slot 16 maintains the first roller glide 11 in place on the frame 17, with the tab 18 extending into the oven frame 17, and the remainder of the first roller glide 11 positioned externally of the oven frame 17 (within the drawer cavity) to support the oven drawer 8 as previously described. However, embodiments are not limited thereto and other mounting configurations are possible.

For example, as further illustrated in FIG. 9A and the enlarged view shown in FIG. 9B, in addition to the tab 18 extending from the first roller glide 11, protruding portions 18' and 18" may be formed on the rear face of the first roller glide 11 facing the oven frame 17 when installed. The protruding portions 18' and 18" may be made of a moldable resilient plastic material, and preferably may be formed integrally with the roller glide 11. When the first roller glide 11 is positioned in place in slot 16 on the oven range frame 17 via the tab 18 (as described above), the protruding portions 18' and 18" provide a secure interference fit between the first roller glide 11 and the oven frame 17. When made from resilient material (e.g., molded plastic) the protruding portions 18' and 18" can deform against the oven frame 17, thereby providing a tight fit between the first roller glide 11 and the enameled steel (for example) of the oven range frame 17. Thus, the protruding portions 18' and 18" can provide a varying tolerance to acceptably mount the first roller glide 11 to different thicknesses of the coated-material walls of the oven range frame 17, thereby eliminating the need to inventory and install first roller glides 11 with different dimensions to accommodate oven frames having walls with different thicknesses.

Turning back to FIG. 5, similarly to the first roller glide 11, the second roller glide 12 may be mounted to the drawer body 10 with a fastener, such as a screw, bolt, or the like. The fastener may be inserted through a mounting opening 33 formed in the upper portion of the second roller glide 12 and an aligned opening formed in the drawer body 10. However, embodiments are not limited thereto and other mounting configurations are possible.

Figure 10A:
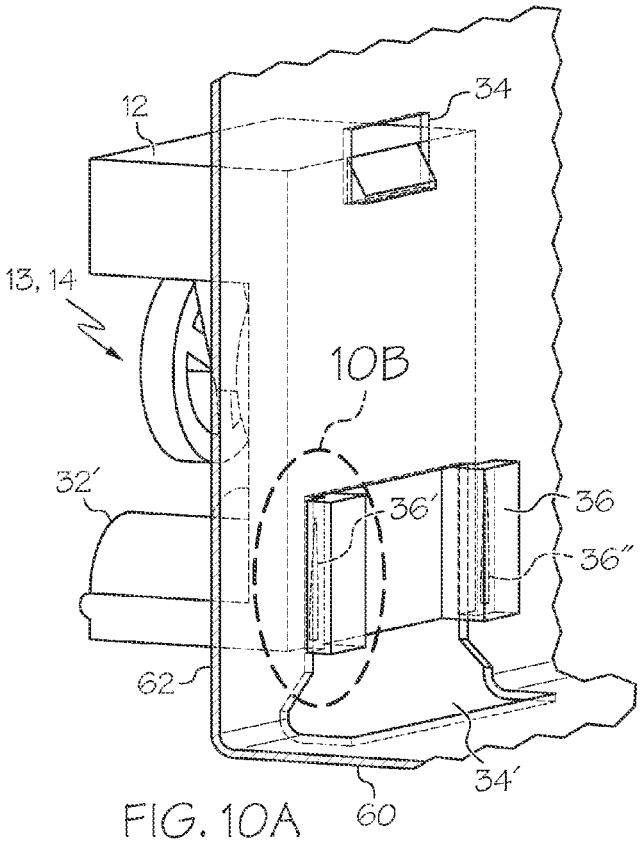
FIG. 10A is a rear perspective view of a no-fastener design of a second roller glide as would be coupled to a drawer or other extractable element in use according to an embodiment, viewed from a position generally behind where the glide is coupled to a side wall of the drawer or other extractable element.
Figure 10B:
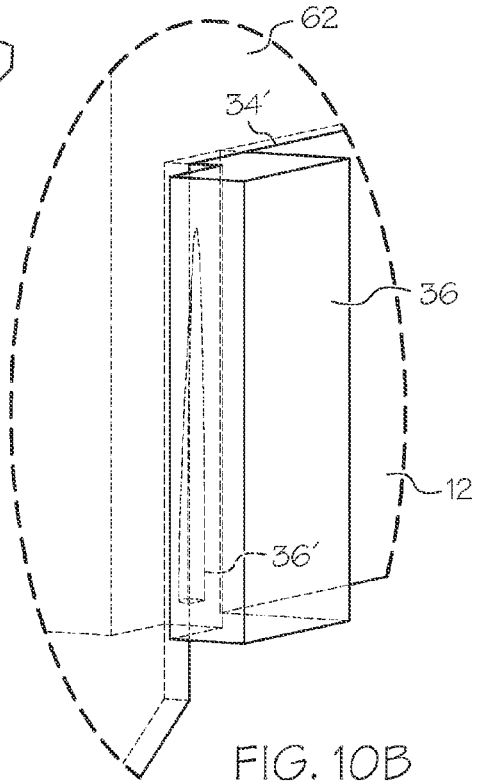
FIG. 10B is an enlarged rear perspective view of a portion of the no-fastener design of the second roller glide according to the embodiment shown in FIG. 10A.

In another embodiment, the second roller glide 12 may be mounted to the drawer body 10 without a separate fastener by utilizing a snap fit. FIG. 10A and FIG. 10B illustrate an embodiment of such a "no fastener" snap fit configuration of the second roller glide 12. As shown in FIG. 10A, a slot 34' or other suitable aperture for receiving opposing tabs 36 of the second roller glide 12 can be formed in the side wall 62 of the drawer body 10. The tabs 36 or other protrusion(s) extending from the second roller glide 12 is/are inserted into the compatibly-shaped slot 34', which can optionally have a "keyhole" shape with a relatively-large lower portion allowing for ready insertion of the tabs 36 and a relatively-smaller or narrower upper portion into which the tabs 36 are subsequently positioned. Once positioned in the relatively-small upper portion, the friction fit between the tabs 36 and the periphery of the slot 34' maintains the second roller glide 12 in place in the side wall 62 of the drawer body 10. As the roller glide 12 continues to slide upward as it is installed, an additional tab positioned relatively above the tabs 36 at the rear face of the roller glide 12 reaches and engages within a second slot 34 in the side wall 62, thereby snapping in place to help retain the roller glide 12 in attachment with the drawer. However, embodiments are not limited thereto and other mounting configurations are possible.

For example, as further illustrated in FIG. 10A and FIG. 10B, in addition to the tabs 36, protruding portions 36' and 36" may be formed on the rear face of the second roller glide 12 facing the side wall 62 of the drawer body 10 that surrounds the slot 34'. When the second roller glide 12 is positioned in place with the tabs 36 received and secured within the slot 34', the protruding portions 36' and 36" provide a secure interference fit between second roller glide 12 and the side wall 62 of the drawer 8. When made from resilient material (e.g., molded plastic) the protruding portions 36' and 36" can deform against the side wall 62 thereby providing a tight fit between the second roller glide 12 and the side wall 62 the drawer body 10. Thus, the protruding portions 36' and 36" can provide a varying tolerance to acceptably mount the second roller glide 12 to different thicknesses of the side walls 62 of the drawer body 10, thereby eliminating the need to inventory and install second roller glides 12 with different dimensions to accommodate drawers with different wall thicknesses.

Figure 11:
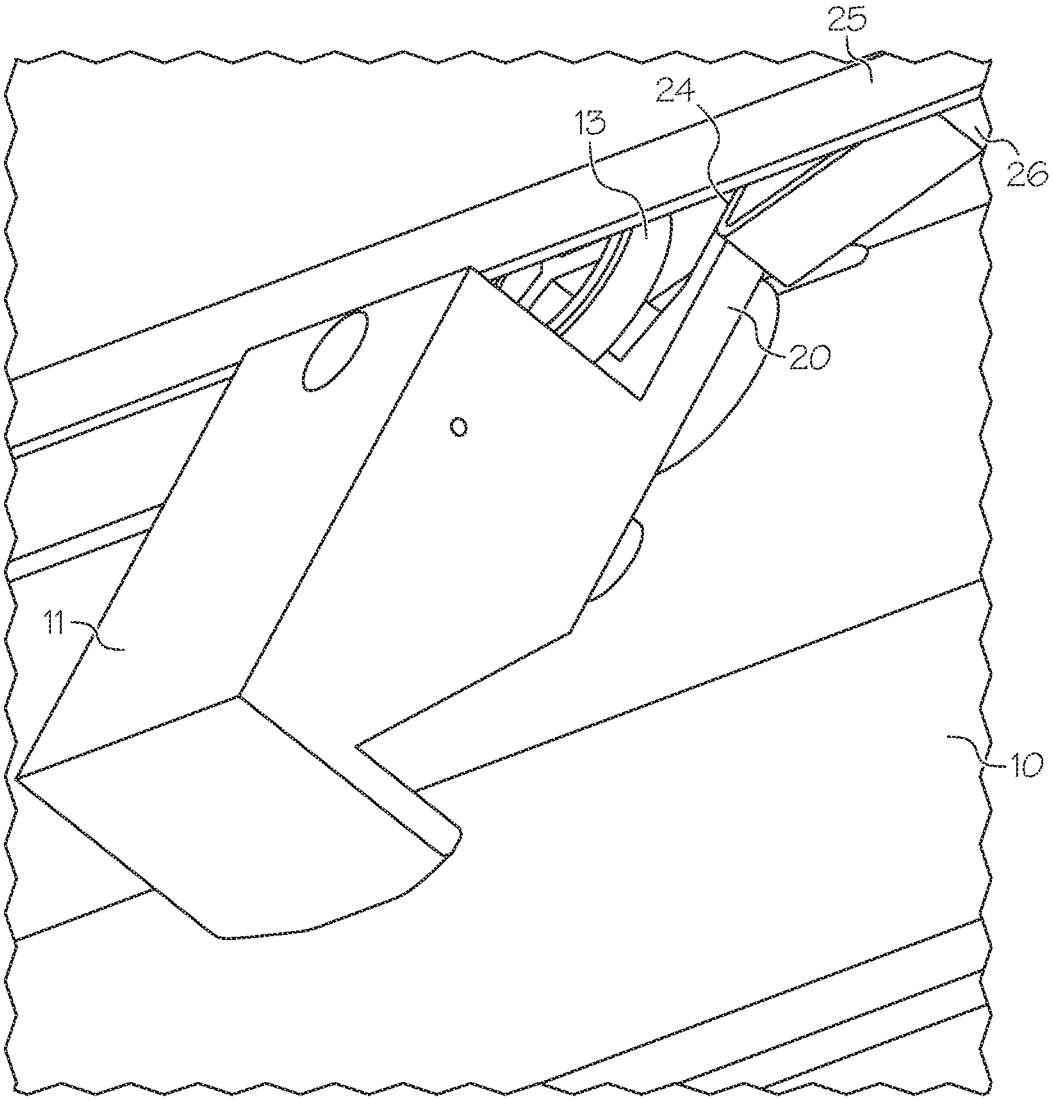
FIG. 11 is an enlarged rear perspective view of a drawer flange along which the wheel of the first roller glide travels according to an embodiment, the drawer according to the present embodiment including a drawer stop that interferes with further opening of the utility drawer beyond a predetermined extent.

As illustrated in FIG. 11, once the first roller glide 11 is installed at a stationary location on the oven range 1, the drawer rail 26 of the drawer body 10 will roll over the wheel 13 of the first roller glide 11 as the drawer 8 is opened and closed. The extent to which the drawer 8 can be opened is established by the location of the stop portion 24 that is formed along the drawer rail 26. As shown in FIG. 11, the drawer stop 20 (previously illustrated in FIG. 4) provided to the first roller glide 11 contacts the stop portion 24 when the drawer 8 has been fully withdrawn from the oven range 1, thereby interfering with further extraction of the drawer 8 without repositioning or otherwise manipulating the oven drawer 8 in a manner other than simply pulling it from the oven range 1. The opposing drawer stops 20, 20' can contact a respective stop portion 24 formed at the forward and rearward extents of drawer travel along the drawer flange 25 (only one stop portion 24 is shown in FIG. 11). The stop portion 24 can be a punched out portion of the material forming the drawer rail 26, or a separately-formed object provided in the drawer rail 26 to inhibit further movement of the first roller glide 11 therein. However, embodiments are not limited thereto and other configurations of the stop portion 24 may be utilized.

FIG. 12 provides an illustration of the assembly of the drawer body 10 within the oven range at a position where it has been fully or nearly fully withdrawn. As seen in the figure, at one side of the drawer 8 the wheel 14 of the second roller glide 12 rolls against and is supported by the base rail 42 of the oven frame 17 and the wheel(s) 13 of the first roller glide 11 rolls against and supports the drawer flange 25 as the drawer is slidably withdrawn and advanced relative to the oven frame 17, as discussed above. The base rail 42 of the oven frame 17 can be formed of the same material as that forming the oven frame 17 and can optionally be integrally molded or formed as part of the monolithic structure of the oven frame 17.

Illustrative embodiments have been described, hereinabove. It will be apparent to those skilled in the art that the above apparatuses and methods may incorporate changes and modifications without departing from the general scope of this disclosure. The disclosure is intended to include all such modifications and alterations disclosed herein or ascertainable herefrom by persons of ordinary skill in the art without undue experimentation.

What is claimed is:

1. A drawer assembly comprising:

a roller glide system configured to facilitate sliding movement between an extended and a retracted position of a drawer, said roller glide system comprising, at a first lateral side of said drawer, a first roller glide and a second roller glide, said first roller glide and said second roller glide being disposed between said drawer and a supporting frame for said drawer, said first roller glide being fixed to said supporting frame for sliding engagement of a first element fixed to and extending longitudinally of said drawer, and said second roller glide being fixed to said drawer for sliding engagement of a second element fixed to and extending longitudinally of said supporting frame, wherein the second roller glide comprises:

a second-roller-glide wheel; and a glide frame of the second roller glide comprising at least one base rail bearing for guiding the second roller glide along the second element, said at least one base rail bearing extending upward from a base of the glide frame of the second roller glide toward said second-roller-glide wheel.

2. The drawer assembly of claim 1, said first roller glide comprising a first-roller-glide wheel that rotates against said first element to facilitate said sliding engagement therebetween.

3. The drawer assembly of claim 2, said first element comprising a first rail depending from said drawer and having a flat surface over which said first-roller-glide wheel rotates, and which is supported against said first-roller-glide wheel.

4. The drawer assembly of claim 1, said second-roller-glide wheel being rotatable against said second element to facilitate said sliding engagement therebetween.

5. The drawer assembly of claim 4, said second element comprising a second rail having a flat surface over which said second-roller-glide wheel rotates, and which is supported against said second-roller-glide wheel.

6. The drawer assembly of claim 1, said roller glide system further comprising, at a second lateral side of said drawer opposite said first lateral side, third and fourth roller glides disposed between said drawer and said supporting frame, said third roller glide being a mirror image of said first roller glide and said fourth roller glide being a mirror image of said second roller glide.

7. The drawer assembly of claim 1, wherein at least one of the first and second roller glides further comprises a snap fit protrusion extending therefrom and configured to be inserted into a compatibly-shaped slot formed on the supporting frame or the drawer, respectively.

8. A cooking appliance comprising the drawer assembly of claim 1.

9. A drawer assembly comprising:

a roller glide system configured to facilitate sliding movement between an extended and a retracted position of a drawer, said roller glide system comprising, at a first lateral side of said drawer, a first roller glide and a second roller glide, said first roller glide and said second roller glide being disposed between said drawer and a supporting frame for said drawer, said first roller glide being fixed to said supporting frame for sliding engagement of a first element fixed to and extending longitudinally of said drawer, and said second roller glide being fixed to said drawer for sliding engagement of a second element fixed to and extending longitudinally of said supporting frame, wherein the second roller glide comprises at least one base rail bearing for guiding the second roller glide along the second element, and wherein the first roller glide comprises:

a first-roller-glide wheel that rotates against said first element to facilitate said sliding engagement therebetween;

a glide frame of the first-roller-glide;

a first bearing shaft mount as part of the glide frame of the first-roller-glide;

said first-roller-glide wheel coupled to a first-roller-glide wheel shaft, said first-roller-glide wheel shaft being configured to be seated in said first bearing shaft mount;

a drawer box guide;

a drawer stop on each longitudinal side of the glide frame of the first-roller-glide; and a first-roller-glide wheel side load bearing formed as a protrusion from said first shaft mount and extending along an arc, said first-roller-glide wheel side load bearing being configured to support an exterior lateral periphery of the first-roller-glide wheel when coupled to the glide frame of the first-roller-glide.

10. The drawer assembly of claim 9, wherein bending of the first-roller-glide wheel shaft is limited based on an engagement of the first-roller-glide wheel against the first-roller-glide wheel side load bearing.

11. The drawer assembly of claim 9, wherein the glide frame of the first-roller-glide is formed symmetrical relative to a vertical axis thereof.

12. The drawer assembly of claim 9, wherein the first roller glide further comprises protruding portions formed symmetrically on both sides of the glide frame of the first-roller-glide facing the supporting frame, said protruding portions being configured to deform when the first roller glide is secured to the supporting frame.

13. The drawer assembly of claim 12, wherein the protruding portions are formed of a resilient plastic material configured to deform against the supporting frame to provide a tight fit between the first roller glide and the supporting frame.

14. A drawer assembly comprising:

a roller glide system configured to facilitate sliding movement between an extended and a retracted position of a drawer, said roller glide system comprising, at a first lateral side of said drawer, a first roller glide and a second roller glide, said first roller glide and said second roller glide being disposed between said drawer and a supporting frame for said drawer, said first roller glide being fixed to said supporting frame for sliding engagement of a first element fixed to and extending longitudinally of said drawer, and said second roller glide being fixed to said drawer for sliding engagement of a second element fixed to and extending longitudinally of said supporting frame, wherein the second roller glide comprises:

at least one base rail bearing for guiding the second roller glide along the second element;

a second-roller-glide wheel that rotates against said second element to facilitate said sliding engagement therebetween; and a glide frame of the second roller glide, wherein the at least one base rail bearing extends from a base of the glide frame of the second roller glide generally toward and cooperating with a circumferential surface of said second-roller-glide wheel to define a pathway therebetween through which said second element translates relative to the second roller glide when said drawer slidably moves relative to said supporting frame.

15. The drawer assembly of claim 14, said glide frame of the second roller glide further comprising:

a second bearing shaft mount as part of the glide frame of the second roller glide, said second-roller-glide wheel coupled to a second-roller-glide wheel shaft, said second shaft being seated in said second bearing shaft mount;

a base rail side load bearing; and a second-roller-glide wheel side load bearing formed as a protrusion from said second shaft mount and extending along an arc, said second-roller-glide wheel side load bearing being configured to support an exterior lateral periphery of the second-roller-glide wheel when coupled to the glide frame of the second roller glide.

16. The drawer assembly of claim 15, wherein bending of the second-roller-glide wheel shaft is limited based on an engagement of the second-roller-glide wheel against the second-roller-glide wheel side load bearing.

17. The drawer assembly of claim 14, wherein the second roller glide further comprises protruding portions formed symmetrically on both sides of the glide frame of the second roller glide facing the first lateral side wall of said drawer, said protruding portions being configured to deform when the second roller glide is secured to the first lateral side wall of said drawer.

18. The drawer assembly of claim 17, wherein the protruding portions are formed of a resilient plastic material configured to deform against the first lateral side wall of said drawer to provide a tight fit between the second roller glide and the first lateral side wall of said drawer.

19. The drawer assembly of claim 14, said glide frame of the second roller glide further comprising:

two second bearing shaft mounts formed symmetrically on both sides of the glide frame of the second roller glide, said second-roller-glide wheel coupled to a second-roller-glide wheel shaft having two outward protrusions formed on both sides of the second-roller-glide wheel shaft, said two outward protrusions each being seated in said two second bearing shaft mounts;

a base rail side load bearing; and two second-roller-glide wheel side load bearings each formed as a protrusion from each of said two second shaft mounts and each of said two second-roller-glide wheel side load bearings extending along an arc, said two second-roller-glide wheel side load bearings being configured to support an exterior lateral periphery of the second-roller-glide wheel when coupled to the glide frame of the second roller glide.

20. A drawer assembly comprising:

a roller glide system configured to facilitate sliding movement between an extended and a retracted position of a drawer, said roller glide system comprising, at a first lateral side of said drawer, a first roller glide and a second roller glide, said first roller glide and said second roller glide being disposed between said drawer and a supporting frame for said drawer, said first roller glide being fixed to said supporting frame for sliding engagement of a first element fixed to and extending longitudinally of said drawer, and said second roller glide being fixed to said drawer for sliding engagement of a second element fixed to and extending longitudinally of said supporting frame, wherein the second roller glide comprises at least one base rail bearing for guiding the second roller glide along the second element, wherein at least one of the first and second roller glides further comprises a snap fit protrusion extending therefrom and configured to be inserted into a compatibly-shaped slot formed on the drawer or the supporting frame or the drawer, respectively, said slot comprising a keyhole shape having a first portion dimensioned to allow ready insertion of said protrusion and a smaller second portion into which said protrusion can be subsequently positioned and which provides a frictional interference fit therewith.

21. A method of assembling a drawer assembly, comprising the steps of:

arranging a first roller glide and a second roller glide between a drawer and a supporting frame for said drawer to facilitate sliding movement between an extended and a retracted position of the drawer;

attaching the first roller glide to said supporting frame for sliding engagement of a first element fixed to and extending longitudinally of said drawer; and attaching the second roller glide to said drawer for sliding engagement of a second element fixed to and extending longitudinally of said supporting frame, wherein the second roller glide comprises:

a wheel; and a glide frame comprising at least one base rail bearing for guiding the second roller glide along the second element, said at least one base rail bearing extending upward from a base of the glide frame toward said wheel.

22. A method of assembling a drawer assembly, comprising the steps of:

arranging a first roller glide and a second roller glide between a drawer and a supporting frame for said drawer to facilitate sliding movement between an extended and a retracted position of the drawer;

attaching the first roller glide to said supporting frame for sliding engagement of a first element fixed to and extending longitudinally of said drawer;

attaching the second roller glide to said drawer for sliding engagement of a second element fixed to and extending longitudinally of said supporting frame;

providing at least one of the first and second roller glides with a snap fit protrusion extending therefrom and configured to be inserted into a compatibly-shaped slot formed on the supporting frame or the drawer, respectively; and securing at least one of the first and second roller glides on the supporting frame or on the lateral side wall of the drawer body using a frictional interference fit between the snap fit protrusion and a keyhole shape having a first portion dimensioned to allow ready insertion of said protrusion and a smaller second portion into which said protrusion can be subsequently positioned and which provides a frictional interference fit therewith, wherein the second roller glide comprises at least one base rail bearing for guiding the second roller glide along the second element.

23. The method of claim 22, further comprising the steps of:

providing at least one of the first and second roller glides with protruding portions formed symmetrically on both sides of at least one of the first and second roller glides;

configuring said protruding portions to deform when at least one of the first and second roller glides is secured to the supporting frame or to the first lateral side wall of said drawer; and securing the at least one of the first and second roller glides to the supporting frame or on the first lateral side wall of said drawer.

* * * * *